United States Patent [19]

Asano et al.

[11] Patent Number: 4,755,432

[45] Date of Patent: Jul. 5, 1988

[54] THERMAL TRANSFER RECORDING MEDIUM

[75] Inventors: Masao Asano; Yoshiaki Shimizu; Shigehiro Kitamura; Takao Abe, all of Hino, Japan

[73] Assignee: Konishiroku Photo Industry Co., Ltd., Tokyo, Japan

[21] Appl. No.: 7,366

[22] Filed: Jan. 27, 1987

[30] Foreign Application Priority Data

Jan. 30, 1986 [JP] Japan ..... 61-20985

[51] Int. Cl.[4] ..... B41M 5/26

[52] U.S. Cl. ..... 428/421; 428/195; 428/211; 428/212; 428/488.4; 428/913; 428/914

[58] Field of Search ..... 428/200, 201, 202, 203, 428/204, 207, 209, 211, 349, 352, 421, 486, 488.4, 488.1, 913, 914, 195, 212

[56] References Cited

U.S. PATENT DOCUMENTS

| | | | |
|---|---|---|---|
| 4,275,106 | 6/1981 | Watanabe | 428/349 |
| 4,318,953 | 3/1982 | Smith et al. | 428/349 |

FOREIGN PATENT DOCUMENTS

| | | | |
|---|---|---|---|
| 0146790 | 11/1980 | Japan | 428/488.4 |
| 0171992 | 10/1983 | Japan | 428/488.4 |
| 0024688 | 2/1984 | Japan | 428/421 |
| 0115488 | 6/1985 | Japan | 428/488.4 |
| 1605098 | 12/1981 | United Kingdom | 428/421 |

*Primary Examiner*—John E. Kittle
*Assistant Examiner*—P. R. Schwartz
*Attorney, Agent, or Firm*—Frishauf, Holtz, Goodman & Woodward

[57] ABSTRACT

In a thermal transfer recording medium having (i) a support, (ii) a heat-fusible layer containing a heat-fusible substance and (iii) a thermoplastic layer containing a thermoplastic polymer, at least one of said layers containing a colorant, the improvement wherein at least one of said heat-fusible layer and said thermoplastic layer contains a fluorine type surfactant.

According to the invention, a thermal transfer recording medium having uniform smooth surface by coating, and yet affording printing of high quality on both smooth paper and rough paper can be obtained.

15 Claims, 1 Drawing Sheet

THERMAL TRANSFER RECORDING MEDIUM

BACKGROUND OF THE INVENTION

This invention relates to a thermal transfer recording medium, more particularly to a heat-sensitive transfer recording medium having a uniform smooth surface with a stable coating and also giving good printing quality to both smooth paper and rough paper.

In a thermal transfer recording medium, for enhancing sensitivity (transferable at low energy) and making the system compact, the film thickness should be preferably thinner and it is desirable to provide only a colorant layer on the support by coating. However, for releasability, heat transferability, it is usual to provide a layer called peeling layer or adhesive layer composed mainly of a heat-fusible substance by coating between the colorant layer and the support.

On the other hand, also for formation of a colorant layer, for the purpose of avoiding fluctuation of the solid components in the coating solution, improving working environment, effecting cost down of production installation, etc., coating with an aqueous composition has become frequently used.

However, when an aqueous composition is coated on a layer composed mainly of waxes or strongly lipophilic heat-fusible substances, repellency, irregularity, pinholes, etc., are liable to be formed. This may be alleviated to some extent by adding a large amount of surfactants, but then there will ensue a drawback that printing performance becomes worsened.

Accordingly, it would be desirable to develop a technique which enables stable aqueous coating without lowering printing quality.

SUMMARY OF THE INVENTION

An object of the present invention is to provide a thermal transfer recording medium having uniform smooth surface by stable coating, and yet affording printing of high quality on both smooth paper and rough paper.

The above object of the present invention can be accomplished by in a thermal transfer recording medium having (i) a support, (ii) a heat-fusible layer containing a heat-fusible substance and (iii) a thermoplastic layer containing a thermoplastic polymer, at least one of said layers containing a colorant, the improvement wherein at least one of said heat-fusible layer and said thermoplastic layer contains a fluorine type surfactant.

DESCRIPTION OF PREFERRED EMBODIMENTS

Figure 1:
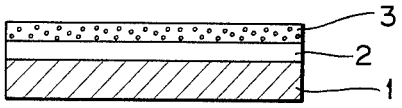
FIG. 1, FIG. 2, FIG. 3 and FIG. 4 are each lateral sectional view as seen in the thickness direction of the recording medium for illustration of the constitution of the thermal transfer recording medium according to the present invention, wherein 1 shows a support, 2 a heat-fusible layer, 3 a thermoplastic layer and 4 a sticking preventive layer.

The present invention will be explained more specifically below.

The fluorine type surfactants to be used in the present invention is not particularly limited, but preferably the compounds represented by the formulae [I]–[VI] shown below may be employed.

$$C_nF_{2n+1}SO_3M \qquad \text{Formula [I]}$$

$$C_nF_{2n+1}SO_2\underset{\underset{R^1}{|}}{N}(CH_2CH_2O)_mH \qquad \text{Formula [II]}$$

$$C_nF_{2n+1}SO_2\underset{\underset{R^1}{|}}{N}-Z-OSO_3M \qquad \text{Formula [III]}$$

$$C_nF_{2n+1}SO_2\underset{\underset{R^1}{|}}{N}-Z-OPO(OH)_2 \qquad \text{Formula [IV]}$$

$$C_nF_{2n+1}SO_2\underset{\underset{R^1}{|}}{N}-Z-COOM \qquad \text{Formula [V]}$$

$$C_nF_{2n+1}CONH-Z-\overset{\overset{R^1}{|}}{\underset{\underset{R^3}{|}}{N}}{}^{\oplus}-R^2\,X^{\ominus} \qquad \text{Formula [VI]}$$

In the formulae [I]–[VI], M represents an alkali metal or an ammonium group, and $R^1$ represents a hydrogen atom or an alkyl group having 1 to 20 carbon atoms. $R^2$ and $R^3$ each represent an alkyl group having 1 to 20 carbon atoms and may be either identical or different. Z represents a divalent linking group, preferably an alkylene group, an arylalkylene group. X represents an anion residue, n an integer of 3 to 20 and m an integer of 2 to 20.

Among them, preferable compounds are those of the formulae [I], [II], [III] and [V], particularly preferable are compounds represented by the formulae [I] and [III].

In the following, representative compounds of the fluorine type surfactants to be used in the present invention are exemplified, but the present invention is not limited thereto.

| | |
|---|---|
| $C_8F_{17}SO_3K$ | I-1 |
| $C_8F_{17}SO_3Na$ | I-2 |
| $C_8F_{17}SO_3Li$ | I-3 |
| $C_8F_{17}SO_3NH_4$ | I-4 |
| $C_6F_{13}SO_3K$ | I-5 |
| $C_6F_{13}SO_3NH_4$ | I-6 |
| $C_8F_{17}SO_2NH(CH_2CH_2O)_{11}H$ | II-1 |
| $C_8F_{17}SO_2\underset{\underset{C_2H_5}{\mid}}{N}(CH_2CH_2O)_{14}H$ | II-2 |
| $C_8F_{17}SO_2\underset{\underset{CH_3}{\mid}}{N}(CH_2CH_2O)_{16}H$ | II-3 |
| $C_8F_{17}SO_2NHCH_2CH_2OSO_3Na$ | III-1 |
| $C_8F_{17}SO_2\underset{\underset{C_2H_5}{\mid}}{N}CH_2CH_2OSO_3Na$ | III-2 |
| $C_8F_{17}SO_2\underset{\underset{CH_3}{\mid}}{N}(CH_2CH_2O)_5SO_3K$ | III-3 |
| $C_8F_{17}SO_2\underset{\underset{C_2H_5}{\mid}}{N}CH_2CH_2OPO(OH)_2$ | IV-1 |
| $C_8F_{17}SO_2\underset{\underset{C_{12}H_{25}}{\mid}}{N}CH_2OPO(OH)_2$ | IV-2 |

-continued $$C_8H_{17}SO_2N(C_{12}H_{25})CH_2CH_2OPO(OH)_2 \quad \text{IV-3}$$

$$C_8F_{17}SO_2NHCH_2COONa \quad \text{V-1}$$

$$C_8F_{17}SO_2N(C_2H_5)CH_2COOK \quad \text{V-2}$$

$$C_8F_{17}SO_2N(C_4H_9)CH_2CH_2COOK \quad \text{V-3}$$

$$C_7F_{15}CONHCH_2CH_2CH_2N^+H(CH_3)_2\ Cl^- \quad \text{VI-1}$$

$$C_9F_{19}CONHCH_2CH_2CH_2N^+(CH_3)_3\ Cl^- \quad \text{VI-2}$$

$$C_7F_{15}CONHCH_2CH_2CH_2N^+(CH_3)_3\ I^- \quad \text{VI-3}$$

In the present invention, the heat-fusible layer contains a heat-fusible substance as the main component (hereinafter called heat-fusible layer), while the thermoplastic layer preferably contains a thermoplastic polymer as the main component (hereinafter called thermoplastic layer). More preferably, the thermoplastic layer is overlaid on the heat-fusible layer.

The layer constitutions of the thermal transfer recording medium of the present invention can be shown by FIG. 1 to FIG. 4. In FIG. 1 to FIG. 4, 1 shows a support, 2 heat fusible layer, 3 a thermoplastic layer and 4 a sticking preventive layer.

Figure 2:
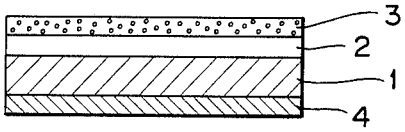
Figure 3:
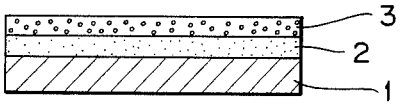
Figure 4:
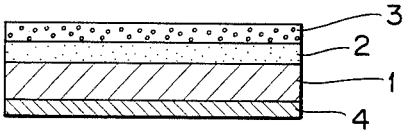

The colorant may be preferably contained in the thermoplastic layer as shown in FIG. 1 and FIG. 2, but it may also be added in a small amount in the heat-fusible layer as shown in FIG. 3 and FIG. 4.

The heat-fusible substance to be used in the present invention may include solid or semi-solid substances at normal temperature, having preferably a melting point (measured value by Yanagimoto MPJ-2 model) or a softening point (measured value by the ring and ball method) of 25° to 120° C., more preferably 40° to 120° C. Specific examples may include vegetable waxes such as carnauba wax, wood wax, auricury wax, espalt wax, etc., animal waxes such as bees wax, insect wax, shellac wax, whale wax, etc., petroleum waxes such as paraffin wax, microcrystalline wax, ester wax, oxidized wax, etc., mineral waxes such as montane wax, ozocerite, ceressin, etc., and other waxes; higher fatty acids such as palmitic acid, stearic acid, margaric acid, behenic acid, etc.; higher alcohols such as palmityl alcohol, stearyl alcohol, behenyl alcohol, marganyl alcohol, myrisyl alcohol, eicosanol, etc.; higher fatty acid esters such as cetyl palmitate, myrisyl palmitate, cetyl stearate, myrisyl stearate, etc.; amides such as acetamide, propionic acid amide, palmitic acid amide, stearic acid amide, amide wax, etc.; rosin derivatives such as ester gum, rosin maleic acid resin, rosin phenol resin, hydrogenated rosin, etc.; polymeric materials such as phenolic resin, terpene resin, xylene resin, low molecular weight styrene resin, petroleum resin, aromatic hydrocarbon resin, ethylene-vinyl acetate copolymer, ethylene-ethyl acrylate copolymer, styrene-butadiene copolymer, styrene-ethylene-butylene copolymer, ionomer resin, polyamide resin, polyester resin, epoxy resin, polyurethane resin, acrylic resin, vinyl chloride resin, cellulose resin, polyvinyl alcohol resin, styrene resin, isoprene rubber, chloroprene rubber, natural rubber, etc.; higher amines such as stearylamine, behenylamine, palmitylamine, etc.; and so on. Also, "heat-fusible solid component which is solid at normal temperature" as described in Japanese Unexamined Patent Publication No. 68253/1979 or "vehicle" as described in Japanese Unexamined Patent Publication No. 105579/1980 may be used.

These heat-fusible substances can be readily made into aqueous dispersions and preferably used.

These heat-fusible substance can be used either individually or as a mixture of two or more kinds.

The composition ratio of the components for forming the heat-fusible layer in the present invention is not limited, but it is preferable to use 10% by weight or more (more preferably 30% by weight or more) of the heat-fusible substance based on total weight of all the solids in the heat-fusible layer.

Also, a colorant may be also added in the heat-fusible layer, if necessary. As the colorant, those as described below can be used. The amount of the colorant used may be preferably not more than 20% by weight based on the total weight of all the solids in the heat-fusible layer.

In the heat-fusible layer of the present invention, various additives other than the above components may be also contained. For example, vegetable oils such as castor oil, linseed oil, olive oil, etc., animal oils such as whale oil and mineral oils may be preferably used. Also, anionic surfactants, cationic surfactants, nonionic surfactants, amphoteric surfactants other than the fluorine type surfactant of the present invention may be also used in combination.

The heat-fusible layer in the present invention may be made to have a thickness of 10 μm or less, more preferably 0.5 to 5 μm.

Examples of the thermoplastic polymer to be used in the present invention may include rosin derivatives such as ester gum, rosin maleic acid resin, rosin phenol resin, hydrogenated rosin, etc., phenolic resin, terpene resin, xylene resin, petroleum resin, aromatic hydrocarbon resin, ionomer resin, polyester resin, polyamide resin, polyethylene polypropylene resin, etc., and these can be readily made into aqueous dispersions according to the known methods.

As a more preferable polymer, acrylic resins may be employed. Acrylic resins may be obtained by emulsion polymerization of a monobasic carboxylic acid such as acrylic acid, methacrylic acid, etc., or ester thereof with at least one copolymerizable monomer. As the carboxylic acid monomer, there may be included methyl, ethyl, isopropyl, butyl, isobutyl, amyl, hexyl, octyl, 2-ethylhexyl, decyl, dodecyl, hydroxyethyl, hydroxypropyl esters, etc., of acrylic acid or methacrylic acid. On the other hand, copolymerizable monomers may include vinyl acetate, vinyl chloride, vinylidene chloride, maleic anhydride, fumaric anhydride, styrene, 2-methyl styrene, chlorostyrene, acrylonitrile, vinyltoluene, N-methylolacrylamide, N-methylolmethacrylamide, N-butoxymethylacrylamide, N-butoxymethacrylamide, vinylpyridine, N-vinylpyrrolidone, etc., and at least one may be selected from these.

Also, a diene copolymer is preferred, and typical examples may include emulsified polymers of a diene monomer such as butadiene, isoprene, isobutylene, chloroprene, etc., and the above copolymerizable monomer, such as butadiene-styrene, butadiene-styrenevinylpyridine, butadiene-acrylonitrile, chloroprenestyrene, chloroprene-acrylonitrile, etc.

Also, as a more preferable polymer, there is an ethylene copolymer, including copolymers such as ethylene-vinyl acetate, ethylene-ethyl acrylate, ethylene-methyl methacrylate, ethylene-isobutyl acrylate, ethylene-acrylic acid, ethylene-vinyl alcohol, ethylene-vinyl chloride, ethylene-acrylic acid metal salt, etc.

Otherwise, polyurethane polymers, polyester polymers, etc., may be also employed as the thermoplastic polymer.

In the present invention, the composition ratio of the components for forming the thermoplastic layer is not limited, but it is preferable to use 5 to 40% by weight (more preferably 5 to 35% by weight) of a colorant and 5 to 95% by weight (more preferably 10 to 90% by weight) of a thermoplastic material based on the total weight of all the solids in the thermoplastic layer.

In the thermoplastic layer of the present invention, various additives other than the above components may be also contained. For example, vegetable oils such as castor oil, linseed oil, olive oil, etc., animal oils such as whale oil and mineral oils may be preferably used. Also, anionic, cationic, nonionic, amphoteric surfactants other than the fluorine type surfactant of the present invention may be also used in combination.

The amount of the fluorine type surfactant added to be used in the present invention is preferably 0.05 to 0.5% (more preferably 0.1 to 0.3%) based on the total weight of all the solids in the heat-fusible layer, and 0.05 to 1% (more preferably 0.2 to 0.8%) based on the total weight of all the solids in the thermoplastic layer.

For making better the overlaying characteristic, it is preferable to increase the amount of the surfactant added more in the thermoplastic layer than in the heat-fusible layer. When a surfactant other than that of the present invention is used in combination, it is necessary to make the ion charges coincident with each other.

The colorant to be used in the present invention should be preferably carbon black, or otherwise any of inorganic pigments, organic pigments or organc dyes may be available. Examples of inorganic dyes may include titanium dioxide, zinc dioxide, prussian blue, cadmium sulfide, iron oxide and chromic acid salts of zinc, barium and calcium. As organic pigments, there may be included azo, thioindigo, anthraquinone, anthraanthrone, triphenedioxazine pigments, vat dyes pigments, phthalocyanine pigments such as copper phthalocyanine and derivatives thereof and quinacridone pigments.

Examples of organic dyes may include acidic dyes, direct dyes, disperse dyes, oil soluble dyes, metal containing oil soluble dyes, etc.

As the method for obtaining a coating liquid by dispersing a thermoplastic ink comprising a thermoplastic binder and a colorant as described above, any desired method can be basically employed and, for example, such methods as mentioned below can be employed:

(a) the method in which a thermoplastic binder and a colorant are melted and kneaded, followed by dispersing in water containing optionally a dispersing agent such as surfactants;

(b) the method in which a thermoplastic binder and a colorant are dispersed separately from each other in water containing optionally a dispersing agent such as surfactants, and then these dispersions are mixed;

(c) the method in which a thermoplastic binder is dispersed in water containing optionally a dispersing agent such as surfactants, and then a colorant is added to the dispersion to be mixed therein.

Among them, particularly the method (b) is preferred.

In the present invention, it is also possible to add, in addition to the above respective components, defoaming agents, agents for improving wettability with the heat-fusible layer, etc.

The support to be used in the thermal transfer recording medium of the present invention should desirably have heat-resistant strength as well as high dimensional stability and surface smoothness. As the material, for example, there may be preferably employed any of papers such as plain paper, condenser paper, laminated paper, coated paper, etc., or resin films such as polyethylene, polyethyleneterephthalate, polystyrene, polypropylene, polyimide, etc., and paper-resin film composite, metal sheet such as aluminum foil, etc. The thickness of the support may be generally about 60 μm or less for obtaining good thermal conductivity, particularly preferably 1.5 to 15 μm. Also, the thermal transfer recording medium of the present invention may have any desired constitution on the backside of the support and a backing layer such as sticking preventive layer, etc., may be also provided.

In preparation of the thermal transfer recording medium of the present invention, the techniques suitable for coating a support such as a polymer film with a constituent layer containing a heat-fusible layer and a thermoplastic layer have been well known in the art and these known techniques can be also applied in the present invention. For example, the constituent layer containing a heat-fusible layer and a thermoplastic layer is a layer formed by aqueous coating of an aqueous dispersion composition (latex). As the coating method of the constituent layer containing a heat-fusible layer and a thermoplastic layer of the present invention, any desired technique such as the reverse roll coater method, the extrusion coater method, the gravure coater method or wire bar coating method, etc., can be employed. The thermoplastic layer of the present invention may be made to have a thickness of 20 μm or less, more preferably 0.5 to 8 μm.

The thermal transfer recording medium of the present invention may also have other constituent layers such as a subbing layer (for example, a layer for controlling film attachment), an overcoated layer, etc.

The method for heat transfer recording by use of the thermal transfer recording medium of the present invention is described below.

With the constituent layer surface of the thermal transfer recording medium of the present invention being superposed on a recording sheet such as a plain paper, energy is given from the thermal transfer recording medium side and/or from the recording sheet, by means of a thermal recording device by use of a thermal head, thermal pen or laser, corresponding to the information of image, whereby the thermoplastic layer is given a relatively low energy to result in transfer of a colorant, etc., together with the thermoplastic material onto the recording sheet.

The present invention is described below by referring to Examples, but the embodiments of the present invention are not limited thereto. In the description shown below, "parts" indicate "parts by weight".

COMPARATIVE EXAMPLE 1

On a 3.4 μm polyethyleneterephthalate film, a solution having a composition shown below was applied by use of a wire bar to form a heat-fusible layer with a dry film thickness of 3 μm.

| | |
|---|---|
| Paraffin wax (Candle No. 1, produced by | 9 parts |

-continued

| | |
|---|---|
| Nippon Seirou Co., mp. 54° C.) | |
| Ethylene-vinyl acetate copolymer (EVA) (NUC-3150, produced by Nippon Unicar Co.) | 1 part |
| Toluene | 90 parts |

On the above heat-fusible layer was applied a composition shown below to obtain a thermal transfer recording medium sample (S-1) having a thermoplastic layer with a dry film thickness of 2 μm.

| | |
|---|---|
| Aqueous carbon black dispersion (30%) | 16% (calculated on solid) |
| 2-Ethylhexyl acrylate-methyl methacrylate copolymer latex | 65% (calculated on solid) |
| EVA type latex (VA content 25%, molecular weight about 20000) | 16% (calculated on solid) |
| Surfactant (sodium lauryl sulfate) | 3% (calculated on solid) |

EXAMPLE 1

According to entirely the same procedure as in Comparative example 1 except for using the surfactants according to the present invention I-1, I-4, II-2, II-3, III-1, V-1 in place of the surfactants (sodium lauryl sulfate) in the thermoplastic layer coating composition of Comparative example 1 in the same amount, respectively, thermal transfer recording medium samples (A-1) to (A-6) were obtained. The overlaying coating characteristics are shown in Table 1.

TABLE 1

| Sample | Overlaying characteristic |
|---|---|
| S-1 (Comparative) | Repellent and uniform coating impossible |
| A-1 (Invention) | Good |
| A-2 (Invention) | Good |
| A-3 (Invention) | Good |
| A-4 (Invention) | Good |
| A-5 (Invention) | Good |
| A-6 (Invention) | Good |

Every sample of the present invention exhibited good overlaying characteristic.

COMPARATIVE EXAMPLE 2

On a 3.4 μm polyethyleneterephthalate film, a solution having the composition shown below was applied by use of a wire bar to form a heat-fusible layer with a dry film thickness of 2.5 μm.

| | |
|---|---|
| Aqueous paraffin wax dispersion | 80% (calculated on solid) |
| EVA type latex (VA content 22%, molecular weight about 30000) | 15% (calculated on solid) |
| Aqueous polyethylene monobehenate dispersion (molecular weight of PEG: 4000) | 4% (calculated on solid) |
| Surfactant (sodium lauryl sulfate) | 1% (calculated on solid) |

Further, a composition shown below was applied on the above coated sample to obtain a thermal transfer recording medium sample (S-2) with a dry film thickness of 1.5 μm.

| | |
|---|---|
| Aqueous carbon black dispersion (30%) | 16% (calculated on solid) |
| 2-Ethylhexyl acrylate-methyl methacrylate copolymer latex | 65% (calculated on solid) |
| EVA type latex (VA content 25%, molecular weight about 30000) | 16% (calculated on solid) |

-continued

| | |
|---|---|
| Surfactant (polyoxyethylenelauryl ether) | 3% (calculated on solid) |

EXAMPLE 2

According to entirely the same procedure as in Comparative example 2 except for replacing the surfactants in the heat-fusible layer and the thermoplastic layer of Comparative example 2 with those shown below in Table 2, five kinds of thermal transfer recording medium samples (B-1) to (B-5) were prepared.

TABLE 2

| Sample | Heat-fusible layer | Thermoplastic layer |
|---|---|---|
| S-2 | Sodium lauryl sulfate | Polyoxyethylenelauryl ether |
| B-1 | Sodium lauryl sulfate | Exemplary compound V-3 |
| B-2 | Exemplary compound I-1 | Exemplary compound I-1 |
| B-3 | Exemplary compound III-1 | Exemplary compound I-2 |
| B-4 | Exemplary compound II-2 | Exemplary compound II-3 |
| B-5 | Exemplary compound I-4 | Exemplary compound I-4 |

The overlaying coating characteristics of the respective samples are shown in Table 3.

TABLE 3

| Sample | Overlaying characteristic |
|---|---|
| S-2 (Comparative) | Repellent and uniform coating impossible |
| B-1 (Invention) | Good |
| B-2 (Invention) | Good |
| B-3 (Invention) | Good |
| B-4 (Invention) | Good |
| B-5 (Invention) | Good |

Also in overlaying of aqueous dispersion system-aqueous dispersion system, good overlaying coating characteristics were obtained in samples of the present invention.

These thermal transfer recording medium samples were subjected to printing on plain paper by use of a thermal printer (trially prepared machine having a thin film type serial head with a heat-generating element density of 7 dot/mm) by giving an application energy of 1.0 mj/dot. As the plain paper, a commercially available pure paper (Bekk smoothness: 100 sec.) and a rough paper (Bekk smoothness: 10 sec.) were employed. The results are shown in Table 4.

TABLE 4

| Sample | Printing quality | |
|---|---|---|
| | Pure paper | Rough paper |
| S-1 (Comparative) | x | x |
| A-1 (Invention) | o | Δ–o |
| A-2 (Invention) | o | Δ–o |
| A-3 (Invention) | o | o |
| A-4 (Invention) | o | Δ–o |
| A-5 (Invention) | o | Δ–o |
| A-6 (Invention) | o | o |
| S-2 (Comparative) | x | x |
| B-1 (Invention) | o | Δ–o |
| B-2 (Invention) | o | o |
| B-3 (Invention) | o | o |
| B-4 (Invention) | o | Δ–o |
| B-5 (Invention) | o | o |

Printing quality was evaluated at 3 ranks by visual observation.

0 . . . clear alphabet reproduced

Δ . . . reproduction of alphabet slightly unclear x . . . reproduction of alphabet unclear As is apparent from the Table, it can be appreciated that only the thermal transfer recording medium samples having the surfactants of the present invention in the thermoplastic layer or in the thermoplastic layer and the heat-fusible layer give good printing quality on both of rough paper and pure paper.

We claim:

1. In a thermal transfer recording medium having (i) support, (ii) a heat-fusible layer containing a heat-fusible substance and (iii) a thermoplastic layer containing a thermoplastic polymer, at least one of said layers containing a colorant, the improvement wherein at least one of said heat-fusible layer and said thermoplastic layer is formed from an aqueous coating composition and contains a fluorine type surfactant.

2. The thermal transfer recording medium according to claim 1, wherein said fluorine type surfactant is represented by Formula [I], [II], [III], [IV], [V] or [VI].

$$C_nF_{2n+1}SO_3M, \qquad \text{Formula [I]}$$

$$C_nF_{2n+1}SO_2\underset{\underset{R^1}{|}}{N}(CH_2CH_2O)_mH, \qquad \text{Formula [II]}$$

$$C_nF_{2n+1}SO_2\underset{\underset{R^1}{|}}{N}-Z-OSO_3M, \qquad \text{Formula [III]}$$

$$C_nF_{2n+1}SO_2\underset{\underset{R^1}{|}}{N}-Z-OPO(OH)_2, \qquad \text{Formula [IV]}$$

$$C_nF_{2n+1}SO_2\underset{\underset{R^1}{|}}{N}-Z-COOM \text{ or} \qquad \text{Formula [V]}$$

$$C_nF_{2n+1}CONH-Z-\overset{\overset{R^1}{|}}{\underset{\underset{R^3}{|}}{N^+}}-R^2\,X^-. \qquad \text{Formula [VI]}$$

3. The thermal transfer recording medium according to claim 1, wherein said support, said heat-fusible layer and said thermoplastic layer are positioned in such an order that said heat-fusible layer is overlaid on said support, and further said thermoplastic layer is overlaid on said heat-fusible layer.

4. The thermal transfer recording medium according to claim 3, wherein said heat-fusible layer contains said surfactant in an amount ranging from 0.05 to 0.5% by weight based on the total weight of all the solids in said heat-fusible layer.

5. The thermal transfer recording medium according to claim 4, wherein said heat-fusible layer contains said surfactant in an amount ranging from 0.1 to 0.3% by weight based on the total weight of all the solids in said heat-fusible layer.

6. The thermal transfer recording medium according to claim 3, wherein said thermoplastic layer contains said surfactant in an amount ranging from 0.05 to 1% by weight based on the total weight of all the solids in said thermoplastic layer.

7. The thermal transfer recording medium according to claim 6, wherein said thermoplastic layer contains said surfactant in an amount ranging from 0.2 to 0.8% by weight based on the total weight of all the solids in said thermoplastic layer.

8. The thermal transfer recording medium according to claim 3, wherein said thermoplastic layer contains a colorant.

9. The thermal transfer recording medium according to claim 8, wherein said thermoplastic layer contains said thermoplastic substance and said colorant in an amount of 5 to 95% by weight and 5 to 40% by weight, respectively, based on the total weight of all the solids in said thermoplastic layer.

10. The thermal transfer recording medium according to claim 3, wherein said heat-fusible layer contains a said heat-fusible substance in an amount of 10% by weight or more based on the total weight of all the solids in said heat-fusible layer.

11. The thermal transfer recording medium according to claim 1, wherein said medium has a sticking preventive layer on said support in such a manner that said sticking layer is provided on the opposite side of said support to the side thereof on which said heat-fusible layer and said thermoplastic layer are provided.

12. The thermal transfer recording medium according to claim 1, wherein said thermoplastic layer contains a colorant.

13. The thermal transfer recording medium according to claim 1, wherein said fluorine type surfactant is represented by Formula (I), (II), (III), (IV), (V) or (VI):

$$C_nF_{2n+1}SO_3M \qquad \text{Formula (I)}$$

$$C_nF_{2n+1}SO_2\underset{\underset{R^1}{|}}{N}(CH_2CH_2O)_mH \qquad \text{Formula (II)}$$

$$C_nF_{2n+1}SO_2\underset{\underset{R^1}{|}}{N}-Z-OSO_3M \qquad \text{Formula (III)}$$

$$C_nF_{2n+1}SO_2\underset{\underset{R^1}{|}}{N}-Z-OPO(OH)_2 \qquad \text{Formula (IV)}$$

$$C_nF_{2n+1}SO_2\underset{\underset{R^1}{|}}{N}-Z-COOM \qquad \text{Formula (V)}$$

$$C_nF_{2n+1}CONH-Z-\overset{\overset{R^1}{|}}{\underset{\underset{R^3}{|}}{N^{\oplus}}}-R^2\,X^{\ominus} \qquad \text{Formula (VI)}$$

wherein M represents an alkali metal or an ammonium group; $R^1$ represents a hydrogen atom or an alkyl group having 1 to 20 carbon atoms; $R^2$ and $R^3$ each represent an alkyl group having 1 to 20 carbon atoms and may be either identical or different; Z represents a divalent linking group; X represents an anion residue; n represents an integer of 3 to 20 and m represents an integer of 2 to 20.

14. The thermal transfer recording medium according to claim 13 wherein the surfactant represented by Formula (I) or (III) is used.

15. The thermal transfer recording medium according to claim 13 wherein said surfactant is present in an amount of 0.05 to 0.5% based on the total weight of all solids in the heat-fusible layer; and 0.05 to 1% based on the total weight of all solids in the thermoplastic layer.

* * * * *